United States Patent [19]

Wong et al.

[11] Patent Number: 4,654,611

[45] Date of Patent: Mar. 31, 1987

[54] BROADBAND WAVEGUIDE PHASE SHIFTER

[75] Inventors: Mon N. Wong, Torrance; Jeffrey D. Steele, Costa Mesa, both of Calif.

[73] Assignee: Hughes Aircraft Company, Los Angeles, Calif.

[21] Appl. No.: 782,810

[22] Filed: Oct. 2, 1985

[51] Int. Cl.[4] ..... H01P 1/18; H01P 9/00

[52] U.S. Cl. ..... 333/157; 333/156; 333/248

[58] Field of Search ..... 333/21 R, 21 A, 156–159, 333/164, 239, 248

[56] References Cited

U.S. PATENT DOCUMENTS 4,100,514 7/1978 DiTullio et al. ..... 333/157 X

*Primary Examiner*—Marvin L. Nussbaum

*Attorney, Agent, or Firm*—J. A. Sawyer, Jr.; M. J. Meltzer; A. W. Karambelas

[57] ABSTRACT

A phase shifter for microwave electromagnetic energy propagating through a waveguide has a composite structure of a series of capacitive phase shifting posts positioned within the waveguide diametrically across from a symmetrically tapered ridge. The series of posts introduce a nominal value of phase shift with an incremental value which increases with increasing frequency of the electromagnetic energy. The tapered ridge introduces a nominal value of phase shift plus an incremental value which decreases with increasing frequency of the electromagnetic energy. The rates of increase and decrease of the incremental values of phase shift cancel so as to provide a resultant phase shift which is substantially invariant with frequency.

18 Claims, 5 Drawing Figures

BROADBAND WAVEGUIDE PHASE SHIFTER

BACKGROUND OF THE INVENTION

This invention relates to waveguide phase shifters and, more particularly, to a phase shifter having a composite structure of series and parallel capacitive elements introducing a compensating frequency dispersive characteristic resulting in a broadband device.

Waveguide phase shifters are frequently employed in microwave circuits for shifting the phase of an electromagnetic signal in one portion of the circuit relative to such signal in another portion of the circuit. The phase shifters are constructed to introduce a phase shift of 90° or other value of phase shift as is required for accomplishing the functions of the microwave circuit.

A requirement of microwave circuits is the capability of operating over a predetermined frequency band. In the case of relatively narrow band requirements, currently available phase shifters are usually sufficiently precise in their operation to provide the desired amount of phase shift at all frequencies in the operating band.

However, a problem arises in the case of broadband microwave circuits wherein the circuit functions are to be accomplished over a relatively broad band. Currently available phase shifters are frequency sensitive with the result that the amount of phase shift imparted by the shifter varies as a function of frequency over the band of interest. In broadband applications, the frequency dispersive characteristic of the phase shifter may be detrimental to the performance of the microwave circuit, particularly at frequencies near the ends of the band of operation.

SUMMARY OF THE INVENTION

The foregoing problem is overcome and other advantages are provided by a waveguide phase shifter which, in accordance with the invention, has a composite structure of series and parallel capacitive elements, each of which introduce a phase shift. The series capacitive elements are sensitive to frequency, and introduce a phase shift which varies as a function of frequency in accordance with a first frequency dispersive characteristic. The parallel capacitive elements also introduce a phase shift which varies with frequency in accordance with a second frequency dispersive characteristic. The physical sizes and arrangement of the series and parallel capacitive elements has been selected so that the first and the second frequency dispersive characteristics essentially cancel each other so as to produce a phase shift which is frequency insensitive. Thus, the phase shifter of the invention can be employed in a microwave circuit with operation over a broad frequency band.

BRIEF DESCRIPTION OF THE DRAWINGS

The foregoing aspects and other features of the invention are explained in the following description, taken in connection with the accompanying drawing wherein.

DESCRIPTION OF THE PREFERRED EMBODIMENTS

Figure 1:
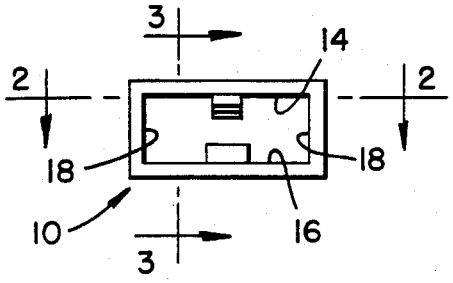
FIG. 1 is an end view of a waveguide phase shifter constructed in accordance with the invention.
Figure 2:
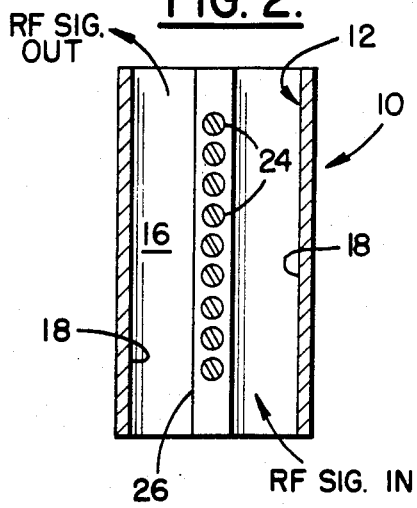
FIG. 2 is a plan view taken in section along the line 2—2 of FIG. 1.
Figure 3:
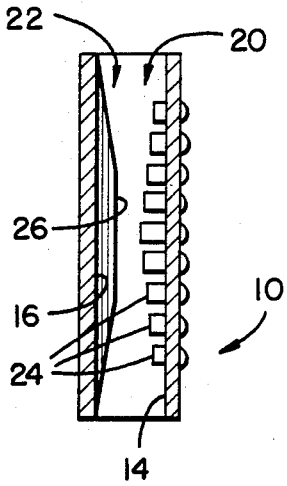
FIG. 3 is a side view of the phase shifter taken in section along the line 3—3 in FIG. 1.

With reference to FIGS. 1, 2 and 3, there is shown a phase shifter 10 for electromagnetic energy. The phase shifter 10 is formed within a waveguide 12 having a rectangular cross-section formed of two broad walls, a top wall 14 and a bottom wall 16, which are joined together by short sidewalls 18. The waveguide 12 supports a transverse electric wave with electric field parallel to the short sidewalls 18. The phase shifter 10 is reciprocal so that electromagnetic energy may enter at either end of the waveguide 12, propagate along a central axis of the waveguide, and exit at the opposite end of the waveguide. The phase shifter 10 is constructed of a metal such as brass or aluminum to provide for electrical conductivity in the walls thereof.

In accordance with the invention, the phase shifter 10 is composed of a composite phase shifting structure comprising an upper phase shifter 20 disposed on the inner side of the top wall 14, and a lower phase shifter 22 disposed on the inner side of the bottom wall 16. The upper phase shifter 20 comprises a series of nine posts 24 extending from the top wall 14 partway towards the bottom wall 16. The lower phase shift 22 comprises a ridge 26 extending from the bottom wall 16 partway to the top wall 14. The series of posts 24 and the ridge 26 are located diametrically opposite each other on opposite sides of the waveguide 12, extend parallel to the axis of the waveguide 12, and are located on center lines of their respective broad walls 14 and 16.

Figure 4:
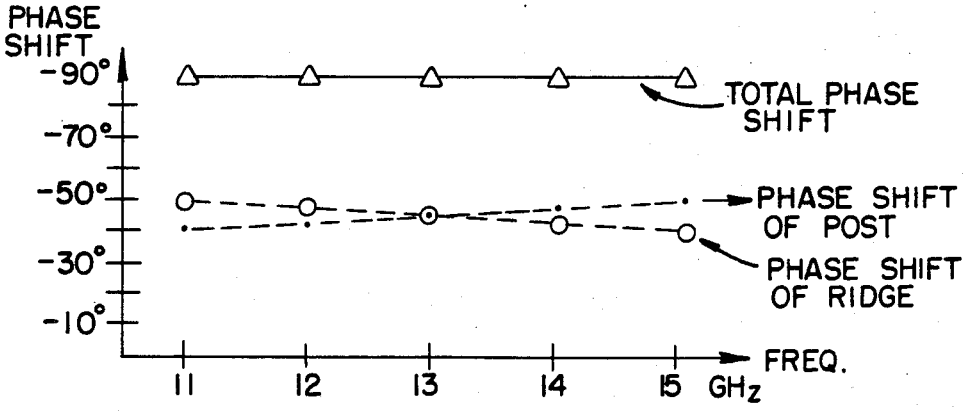
FIG. 4 is a graph showing the frequency dispersive characteristics of series and parallel phase-shifting elements of FIGS. 1–3.

An important feature of the invention is made evident by the graph of FIG. 4 in which the total phase shift contribution of the series of posts 24 is shown to increase slowly with increasing frequency. This results from the frequency sensitivity of the posts 24 in the introduction of a phase shift to microwave energy propagating along the waveguide 12. The phase shift produced by the ridge 26 is shown by the graph to decrease in magnitude with increasing frequency. This is in accordance with a frequency sensitivity of the ridge 26 in the introduction of a phase shift to microwave energy propagating along the waveguide 12.

Each of the posts 24 introduces a phase shift of approximately −5°, for a total contribution of all nine posts 24 of a nominal value of approximately −45°. The ridge 26 introduces a phase shift having a nominal value of approximately −45°. The series of posts 24 provide an incremental phase shift which increases with increasing frequency of the electromagnetic energy, the incremental phase shift being in addition to the nominal value of phase shift. The ridge 26 provides an incremental phase shift which decreases with increasing frequency of the electromagnetic energy, the incremental phase shift being in addition to the nominal value of phase shift. The rate of increase in phase shift produced by the posts 24, as a function of frequency, is equal and opposite to the rate of decrease of phase shift produced by the ridge 26. Thereby, upon a combination of the phase shift of the series of posts 24 and of the ridge 26, an essentially constant value of −90° is attained for all values of frequency in the operating band of the phase shifter 10. In the preferred embodiment of the invention, the operating band extends over a frequency range of 11 GHz (gigahertz) to 15 GHz.

In the construction of a preferred embodiment of the invention, waveguide type WR-75 is employed with an aspect ratio of the widths of a broad wall to a short wall of 2:1. The width of the waveguide 12 between sidewalls 18 is 0.75 inch, this being approximately ¾ of the free space wavelength in the operating band. Each of the posts 24 has a width of 0.187 inches. The amount of extension of the posts 24 into the waveguide 12 varies with the location of the respective posts 24. Thus, the two posts on the ends of the sequence of posts each extend a relatively short distance while the post in the middle of the sequence extends a maximum distance. Beginning at one end of the sequence, the amount of extension of each of the posts 24 is as follows: 0.030 inch, 0.070 inch, 0.095 inch, 0.110 inch, 0.1105 inch, with the remaining four posts having the same lengths as the first four posts so as to provide symmetry to the array of the posts 24. The overall length of the waveguide 12 is three inches, and the spacing between the end of the waveguide 12 and the nearest post 24 is 0.35 inch. The spacing between posts 24, as measured between center lines of the posts, is 0.290 inch, this being less than ¼ of the guide wavelength.

With respect to the construction of the ridge 26, the ridge has a taper on both ends, this providing a symmetry to the shape of the ridge 26 as viewed in FIG. 3. The ridge 26 extends a maximum amount of 0.095 inch into the waveguide 12 from the bottom wall 16, the maximum extension being constant over a central portion having a length of one inch as measured along a central axis of the waveguide 12. The tapered end portions of the ridge 26 extend for a distance of 1 inch, and taper from the foregoing maximum value of extension down to a value of zero at the ends of the waveguide 12. The width of the ridge 26, as measured in a direction transverse to the waveguide 12, is 0.295 inch. The spacing between the outer surfaces of the posts 24 and a sidewall 18 is greater than approximately ¼ free-space wavelength. Also, the spacing between the outer surface of the ridge 26 and the sidewall 18 is greater than ¼ free-space wavelength.

Figure 5:
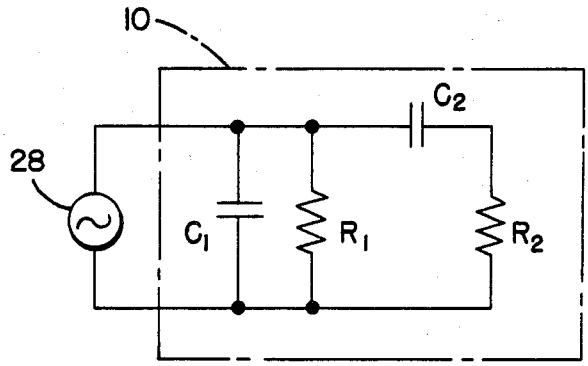
FIG. 5 is an electrical schematic diagram useful in explaining the operation of the series and the parallel phase-shifting elements of the phase shifter.

The operation of the invention may be further understood with reference to the schematic diagram of FIG. 5. The source 28 of RF (radio frequency) energy applies a microwave signal to the phase shifter 10. The schematic representation of the phase shifter 10 includes two capacitors C1 and C2, and two resistors R1 and R2. The parallel combination of C1 and R1 represent the admittance presented by the series of posts 24, and the series combination of C2 and R2 represent the admittance presented by the ridge 26. Each of these admittances is connected across the terminals of the source 28. Thus, the total admittance presented to the source 28 is the sum of the admittance of the posts 24 and the admittance of the ridge 26. The resultant phase angle is, accordingly, the sum of the phase angles of the admittance of the series of posts 24 plus the phase angle of the admittance of the ridge 26.

In view of the fact that the admittance of the posts 24 is represented by a parallel connection of C1 and R1, and the admittance of the ridge 26 is represented by a series connection of C2 and R2, the frequency responsivity of the two admittances differs. With increasing frequency, the parallel combination of C1 and R1 provides increasing phase angle in accordance with the relationship shown in FIG. 4. Also, with increasing frequency, the phase angle introduced by the series connection of C2 and R2 results in a decreasing phase angle in accordance with the relationship shown in FIG. 4. The rate of increase of phase angle balances the rate of decrease of phase angle. Thereby, the phase shifter 10, embodying the structure of the invention, is able to compensate the frequency dispersive characteristics of the upper and the lower phase shifters 20 and 22 so as to provide a substantially flat response across the operating band of the phase shifter.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A broadband waveguide phase shifter comprising:

a waveguide;

a first phase shift assembly and a second phase shift assembly located within said waveguide along a path of propagation of radiant energy the first assembly further comprises a series of phase shifting posts and the second assembly further comprises a ridge,; and wherein each of said assemblies presents a load to said radiant energy, the load of said first assembly including a reactive element in parallel with a resistive element, and the load of said second assembly including a reactive element in series with a resistive element to enable said first assembly to have a phase dependency on frequency which is opposite to such phase dependency of said second assembly.

2. A phase shifter according to claim 1 wherein said waveguide comprises electrically conductive walls arranged with a cross-sectional configuration of two broad walls connected by two short sidewalls.

3. A phase shifter according to claim 2 wherein said first assembly sets on one of said broad walls, and said second assembly sets on a second of said broad walls.

4. A phase shifter according to claim 3 wherein said first assembly and said second assembly are positioned diametrically across from each other on opposite sides of said waveguide.

5. A phase shifter according to claim 4 wherein said first assembly and said second assembly extend in a direction of propagation of the radiant energy.

6. A phase shifter according to claim 1 wherein said first assembly comprises a series of phase shifting posts, and said second assembly comprises a symmetrically tapered ridge.

7. A phase shifter according to claim 6 wherein said series of posts and said ridge extend in a direction of propagation of the radiant energy.

8. A phase shifter according to claim 6 wherein said waveguide comprises electrically conductive walls arranged with a cross-sectional configuration of two broad walls connected by two short sidewalls, said first assembly sets on one of said broad walls, and said second assembly sets on a second of said broad walls.

9. A phase shifter according to claim 1 wherein said ridge and said posts are positioned diametrically across from each other on opposite sides of said waveguide.

10. A phase shifter according to claim 9 wherein said series of posts and said ridge extend in a direction of propagation of the radiant energy.

11. A phase shifter according to claim 9 wherein said ridge is symmetrically tapered along a direction of propagation of the radiant energy.

12. A phase shifter according to claim 9 wherein said waveguide comprises electrically conductive walls arranged with a cross-sectional configuration of two broad walls connected by two short side walls, said first assembly sets on one of said broad walls, said second assembly sets on a second of said broad walls, and said series of posts and said ridge extend in a direction of propagation of the radiant energy.

13. A broadband waveguide phase shifter comprising:

a waveguide;

first phase shift means and second phase shift means positioned within said waveguide for interaction with radiant energy propagating in said waveguide, said first phase shift means providing a nominal value of phase shift plus an incremental phase shift which increases at a predetermined rate with increasing frequency of the radiant energy, and said second phase shift means providing a nominal value of phase shift plus an incremental phase shift which decreases at a predetermined rate with increasing frequency of the radiant energy; said means comprises a series of phase shifting posts and said second phase shift means comprises a ridge; and wherein the rate of increase of the incremental phase shift of said first phase shift means is substantially equal to the rate of decrease of the incremental phase shift of said second phase shift means providing a combined phase shift to the radiant energy which is substantially invariant with frequency.

14. A phase shifter according to claim 13 wherein said first phase shift means comprises a series of phase shifting posts, and said second phase shift means comprises a symmetrically tapered ridge.

15. A phase shifter according to claim 13 wherein each of said phase shift means presents a load to said radiant energy, the load of said first phase shift means including a reactive element in parallel with a resistive element, and the load of said second phase shift means including a reactive element in series with a resistive element to enable said first phase shift means to have a phase dependency on frequency which is opposite to such phase dependency of said second phase shift means.

16. A phase shifter according to claim 15 wherein said first phase shift means comprises a series of phase shifting posts, and said second phase shift means comprises a symmetrically tapered ridge.

17. A phase shifter according to claim 16 wherein said series of posts and said ridge extend in a direction of propagation of the radiant energy.

18. A phase shifter according to claim 17 wherein said waveguide comprises electrically conductive walls arranged with a cross-sectional configuration of two broad walls connected by two short side walls, said first phase shift means sets on one of said broad walls, said second phase shift means sets on a second of said broad walls, and said first and said second phase shift means are positioned diametrically across from each other on opposite sides of said waveguide.

* * * * *